United States Patent [19]

Conway

[11] 4,170,394

[45] Oct. 9, 1979

[54] HIGH VOLTAGE SEPARABLE CONNECTOR SYSTEM WITH MODIFIED DWELL POSITION

[75] Inventor: Gerard V. Conway, Pittsfield, Mass.

[73] Assignee: General Electric Company, Philadelphia, Pa.

[21] Appl. No.: 833,329

[22] Filed: Sep. 14, 1977

[51] Int. Cl.[2] ..... H01R 13/52

[52] U.S. Cl. ..... 339/111; 200/144 C; 200/149 A; 339/143 R

[58] Field of Search ..... 339/111, 143 R, 46; 200/144 C, 149 A

[56] References Cited

U.S. PATENT DOCUMENTS

| | | | |
|---|---|---|---|
| 3,763,461 | 10/1973 | Kotski | 339/111 |
| 3,860,322 | 1/1975 | Sankey et al. | 339/111 |
| 3,945,699 | 3/1976 | Westrom | 339/111 X |
| 3,989,341 | 11/1976 | Ball | 339/111 |

*Primary Examiner*—Roy Lake
*Assistant Examiner*—DeWalden W. Jones
*Attorney, Agent, or Firm*—William Freedman; Carl L. Silverman

[57] ABSTRACT

A separable electrical connector assembly includes mating rod connector and bore switch modules. The bore switch module includes a grasping bore contact member for electrically engaging with a rod contact member which is included in the rod connector module. The rod contact member includes an arc follower at its engaging end. The assembly includes means for providing an operator, during a make operation, with a modified dwell position immediately following which electrical engagement of the rod and bore contact members is made. At the modified dwell position, further insertion of the rod contact member into the switch module is met by a noticeable resistance. At the modified dwell position, a predetermined distance separates the arc follower and the grasping bore contact member. In one embodiment, the bore switch module includes two axially spaced annular grooves respectively containing a gas sealing ring and a stop ring. The rod contact member includes two spaced annular recesses. These annular recesses are positioned such that, at the modified dwell position, the stop ring wedges between one recess of the rod contact member and the stop ring groove of the switch module. This provides the noticeable resistance to further insertion of the rod contact member through the stop ring and into the switch module. A vigorous closing force to the rod connector module overcomes the stop ring resistance, permitting further insertion of the rod contact member and electrical engagement of the rod and bore contact members. In the electrically engaged position, the stop ring and the gas sealing ring of the switch module are aligned with the other recess in the rod contact member thereby allowing the stop and gas sealing rings to relax.

17 Claims, 7 Drawing Figures

HIGH VOLTAGE SEPARABLE CONNECTOR SYSTEM WITH MODIFIED DWELL POSITION

BACKGROUND OF THE INVENTION

The present invention relates to separable electrical connector assemblies, and more particularly to such a connector assembly having a modified dwell position.

Separable connector assemblies for underground power distribution cable, or shielded cable, are watertight when assembled and may be readily separated into two or more units to break a cable connection. Such units are separately commercially available and are commonly referred to as "modules". A connector assembly includes two or more matching modules assembled together. In accordance with customer requirements, standardization of the dimensions of parts allows for interchangeability of correspondingly rated modules of different manufacturers.

One type of separable connector assembly commonly used is a "rod and bore" switching type. In this assembly, a switch module includes a receiving bore tube, or snuffer, which is situated within a passageway in a shielded, insulating housing. The passageway includes a grasping contact member at the interior end of the bore tube. A matching rod connector module includes a rod contact member which is inserted into the bore tube for electrical engagement with the bore grasping contact member. Exemplary rod and bore type separable electrical connector assemblies are disclosed in the following U.S. Pat. Nos.: 3,542,986 issued Nov. 24, 1970 to Kotski; 3,551,587 issued Dec. 29, 1970 to Propst; and 3,587,035 issued June 22, 1970 to Kotski.

Generally, in the previously described connector assemblies, means for extinguishing arcs generated in breaking electrical contact are provided. A common technique is to provide the bore of the snuffer tube with a liner of ablative material, i.e., a material which generates arc extinguishing gases when subjected to an electric arc. In addition, the rod contact member includes an arc follower, a rod shaped extension at the end of the rod contact. The arc follower is also of ablative material. Thus, when the rod contact is pulled from the grasping contact of the bore module, i.e., "loadbreak" conditions, the resulting arc passes between the arc follower and the snuffer liner thereby exposing the ablative material to the arc. The ablative material then generates arc extinguishing gases which rapidly extinguish the arc. This permits the connector assembly to be utilized as a switch which is operable under energized conditions.

Although the previously described separable electrical connector assemblies are widely used, they do suffer from certain problems. To fully appreciate such problems, it is necessary to review the industrial practices common to separable electrical connector assembly usage. More particularly, in connection with making electrical contact between the rod and bore contacts, or "loadmake" condition, an operator manually moves the rod connector module (with its rod contact member) toward engagement with the bore grasping contact member of the switch module through the use of a conventional "hot stick" or other suitable insulating means. The point at which a noticeable resistance to further insertion of the rod contact member into the switch module is felt is generally defined as the "dwell position" of the connector assembly. The dwell position is associated with the position in which the arc follower of the rod contact member first engages the bore grasping contact. At this point, only the length of the arc follower separates the conductive rod contact and the bore grasping contact. Operators are cautioned not to hold the rod contact member in this dwell position but to instead immediately thrust the rod contact member further into the switch module to electrically engage the rod contact member with the bore grasping contact.

It is to be further appreciated that certain standards have been established for testing separable electrical connector systems which are designed for making and breaking electrical contact, i.e., loadmake and loadbreak operation. For example, ANSI Standards (C119.2) of Revision 1 include the following operating procedure: "The operator shall maintain a minimum dwell time of 5 seconds after the probe (arc follower of the rod contact member) is positioned in the arc extinguishing area of its mating part (switch module)". This is generally interpreted as the dwell position.

Tests have shown that the dwell position previously referred to is satisfactory at contact voltages between rod and bore up to about 22 kV in standard electrical connector assemblies such as those having a 8.3/14.4 kV three phase rating or a 21.2 kV single phase rating. However, at the next higher standard contact voltage of 26.3 kV, electrical breakdown may occur across the arc follower, even when operating in accordance with standard minimum dwell time conditions. This results in an undesirable prestrike which is detrimental to successful operation of the connector assembly. Although the undesirable prestrike condition can be prevented through several techniques, none of the available techniques is satisfactory. One such technique is to make the arc follower sufficiently long so as to withstand the increased contact voltage. This technique thus requires an increased length of the switch module which interferes with the presently existing need for interchangeability of connector assembly parts. Other techniques have included the use of an acceptable standard length of arc follower, e.g., 2.3 to 2.5 inches in combination with conductive core pins in the arc follower. However, this technique has not shown the ability to consistently withstand a contact voltage of 26.3 kV.

Therefore, it is a general object of this invention to provide an improved separable electrical connector assembly in which there is reduced chance for an intercontact breakdown when the connector module is in the dwell position.

Another object of this invention is to provide such a separable electrical connector assembly which can be operated in a manner consistent with common industrial usage.

Another object of this invention is to provide such a separable electrical connector assembly in which a modified dwell position is provided.

Another object of this invention is to provide such a separable electrical connector assembly in which the modified dwell position minimizes the need to depart from conventional electrical connector structure.

Another object of this invention is to provide such a separable electrical connector assembly which is capable of operation at 26.3 kV or higher.

Another object of the present invention is to provide an increased voltage rating for a connector assembly having a given arc follower.

Further objects and advantages will become apparent as the description proceeds and the features of novelty which characterize my invention will be pointed out with particularity in the claims annexed to and forming a part of the specification.

SUMMARY OF THE INVENTION

In carrying out my invention in one form, I provide a separable connector assembly of the type which includes mating switch and connector modules respectively having mating bore and rod contact members. Each of the modules includes an insulating housing. The rod contact member includes an arc follower at the contact engaging end thereof. The assembly includes means for providing a noticeable physical resistance to further insertion of the rod contact member into the switch module beyond a first insertion. This resistance corresponds to a modified dwell position immediately following which electrical engagement of the rod and bore contact members is made. At the modified dwell position, the arc follower is separated a predetermined distance from the bore contact member.

BRIEF DESCRIPTION OF THE DRAWINGS

For a better understanding of the invention, reference may be had to the following description taken in conjunction with the accompanying drawings, wherein.

DETAILED DESCRIPTION OF THE INVENTION

Figure 1:
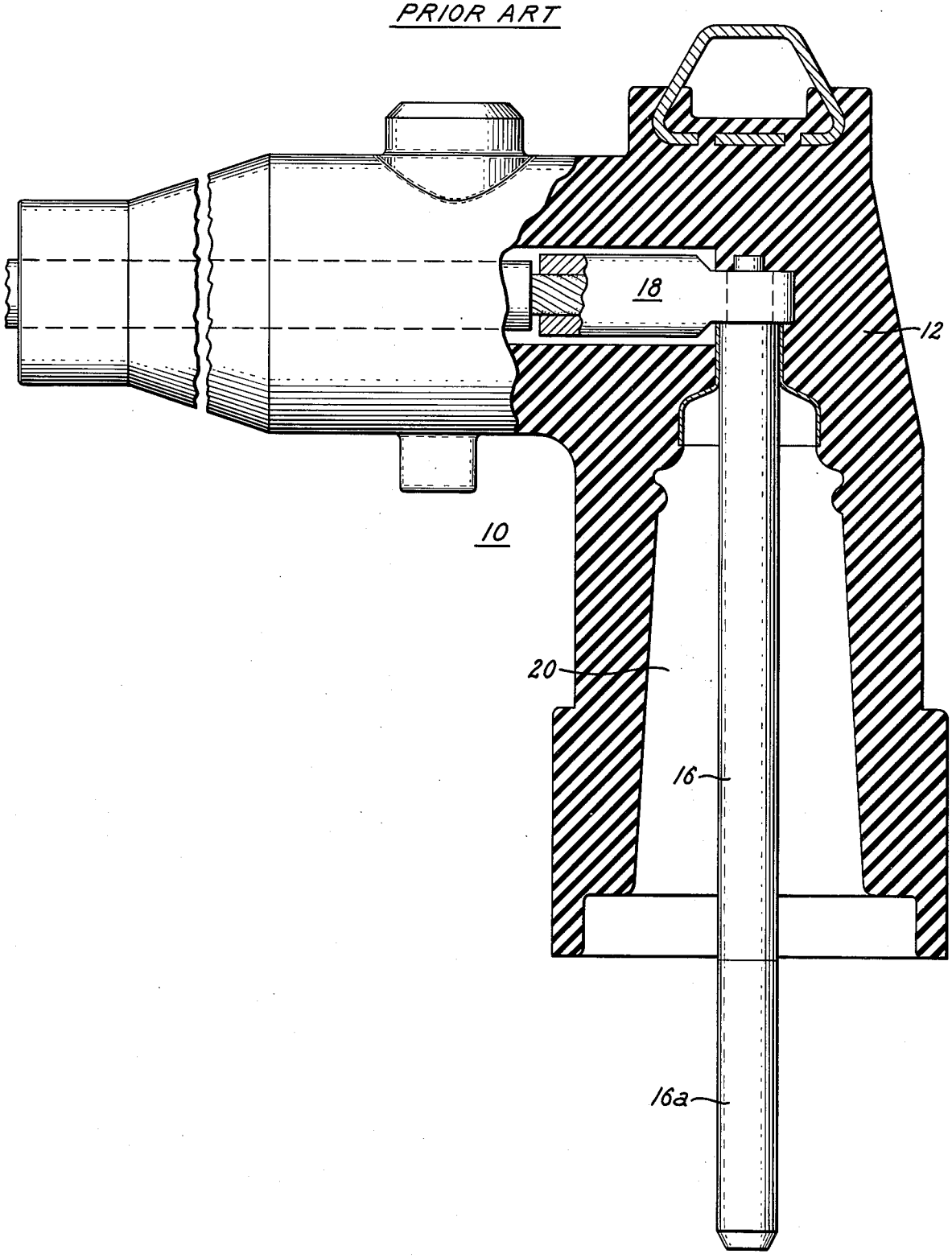
Fig. 1. PRIOR ART
FIG. 1 is a partially broken away side view of a portion of one form of prior art separable electrical connector module to which the present invention relates.

Referring initially to FIG. 1, one form of a prior art separable electrical rod connector module to which the present invention relates is generally designated 10. The rod connector module 10 includes an elastomeric housing 12 of a material such as EPDM (ethylene-propylene-dienemonomer) rubber which is provided on its outside surface with a conductive shield layer which is grounded (not shown). One end of a metal rod contact 16, of a material such as copper, extends from a conductor contact 18 within the housing 12 into a cup shaped recess 20 of the housing 12. At the opposite end of the metal rod contact 16 extends an arc follower **16*a* of ablative material. The unattached end of the arc follower 16*a* is tapered. A preferred ablative material for the arc follower 16*a*** is acetal copolymer resin loaded with finely divided melamine from about 20% to about 60% of the weight of the material. The ablative material is typically injection molded on an epoxy bonded glass fiber reinforcing pin. Further information on this ablative material can be found in copending patent application of Ser. No. 716,130, filed Aug. 20, 1976, entitled, "Electrical Switch with Melamine Loaded Thermoplastic Ablative Material", assigned to the assignee of the present application and hereby incorporated by reference in the present application.

Figure 2:
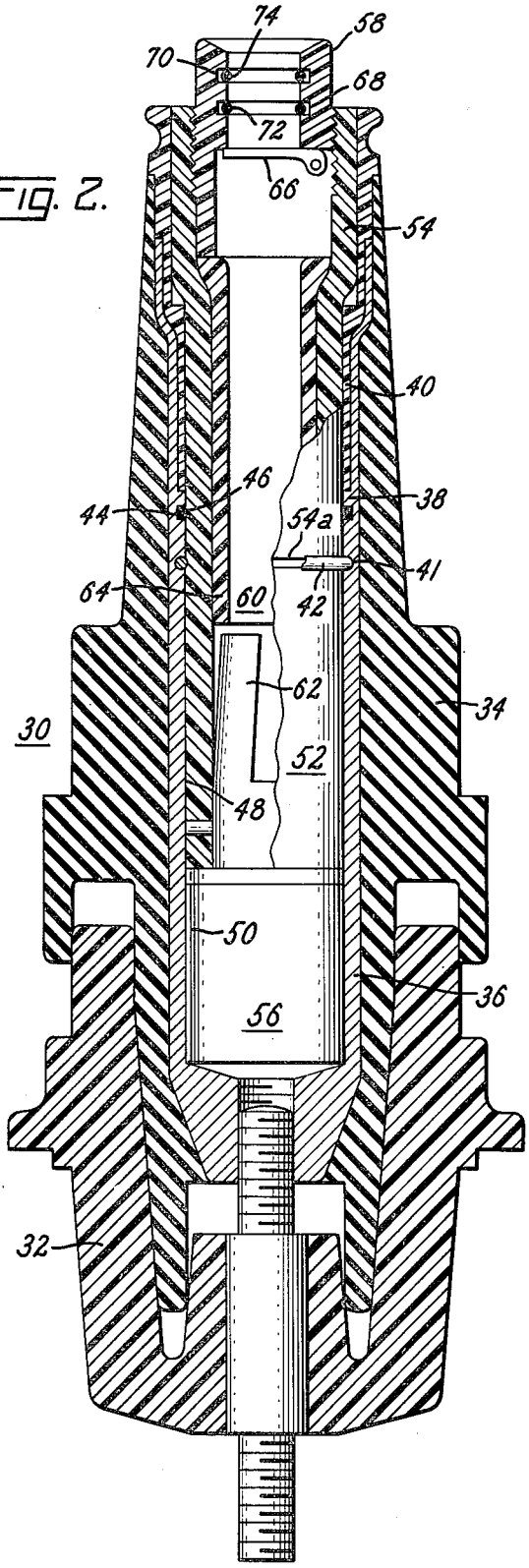
FIG. 2 is a partially broken away view of a portion of one form of a separable electrical switch module to which the present invention relates.

Referring now to FIG. 2, one form of bore switch module to which the present invention relates is generally designated 30. The bore switch module 30 is designed to be mated with the connector module 10 of FIG. 1 at one end (forming a separable electrical connector assembly) and to be rigidly mounted at the other end into a standardized bushing well 32 of the type generally present in a transformer housing. The bore switch module 30 comprises an insulating housing 34 of a material such as EPDM (ethylene-propylene-dienemonomer) rubber in which there is embedded a metal sleeve 36 having receiving threads for a mounting stud at one end to hold the switch module 30 in place in the bushing well 32. The portion of the switch module housing 34 which surrounds the outer or opposing end of the sleeve 36 is a truncated cone which closely matches the configuration of the inside of the recess 20 of the rod connector module 10 of FIG. 1. As a result, a watertight electrically insulating seal is formed when the rod connector module 10 and bore switch module 30 are joined together. The outer end portion of the sleeve 36 is expanded somewhat in diameter with a resulting shoulder 38 and provided with internal threads so that a nose piece 40 of a material such as glass filled nylon can be threaded into it. A shallow groove 41 is formed in the wall of the sleeve 36 adjacent the shoulder 38 and an open steel retaining ring 42 inserted therein. Resting against the shoulder 38 in a second groove 44 adjacent the first groove 41 is a resilient gas sealing "O" ring gasket 46. The interior wall 48 of the sleeve 36 includes 3 keyribs 50 formed therein, each having a substantially rectangular cross section and running longitudinally from the inner end of the sleeve 36 to just below the steel retaining ring 42. Note, only one keyrib 50 is partially shown in FIG. 2. The keyribs 50 are equally spaced angularly about the axis of the sleeve 36.

Closely fitted into the sleeve 36 is a bore contact unit 52. The contact unit 52 includes a container tube 54 of insulating material such as glass filled thermoplastic resin or glass filled thermoset resin. One end of the container tube 54 is threaded and joined to an annular slidable conductive piston 56. The piston 56 includes an outwardly flanged portion for resiliently engaging the inner surfaces of the keyribs 50 so as to thereby provide electrical contact between the sleeve 36 and the contact unit 52. The other end of the container tube 54 includes internal threads for receiving a collar unit 58. The insulating container tube 54 includes a shallow annular groove **54*a* positioned to align with the steel retaining ring 42. Further information on the switch module 30**, as hereinbefore discussed, can be found in copending patent application of Ser. No. 751,692, filed Dec. 17, 1976, entitled "Electrical Connector Switching Module", and assigned to the assignee of the present invention. This application is hereby incorporated by reference in the present application.

The contact unit 52 includes a snuffer-contact assembly 60 which includes a copper grasping bore contact 62 for electrically engaging a rod contact. An ablative snuffer liner 64 is provided in the container tube 54 and extends from the bore contact 62 toward the open end of the switch module 30. Further information on the ablative liner can be found in previously mentioned copending patent application of Ser. No. 716,130. The collar unit 58 is made of glass filled thermoplastic resin, glass filled thermoset resin or any other suitable dielectric material and preferably includes a flapper valve 66 and assembly therefor of the type disclosed in U.S. Pat. No. 3,763,461, issued to Kotski, Oct. 2, 1973, entitled, "Electric Cable Termination Module Having a Gas Trap Valve", assigned to the assignee of the present invention. This patent is hereby incorporated by reference in the present application. Spaced from the flapper valve assembly 66 in the direction away from the bore contact 62 are two axially spaced annular grooves 68 and 70 which are disposed in the interior wall of the collar unit 58. The grooves 68 and 70 are respectively adapted to receive "O" ring gas sealing gaskets 72 and 74 of a material such as ethylene-propylene so as to restrict the flow of gases out of the module 30. The "O" ring gas sealing gaskets typically have smaller inside diameters than the rod contact 16 and arc follower **16*a* so as to closely receive the rod contact 16** and arc follower during movement therethrough. The use of such "O" ring gas sealing gaskets is more fully discussed in U.S. Pat. No. 3,982,812, issued Sept. 28, 1976, entitled, "Power Cable Separable Connector Having Gasket Means for Restricting the Flow of Arc Generated Gases Therefrom", assigned to the assignee of the present invention.

Figure 3:
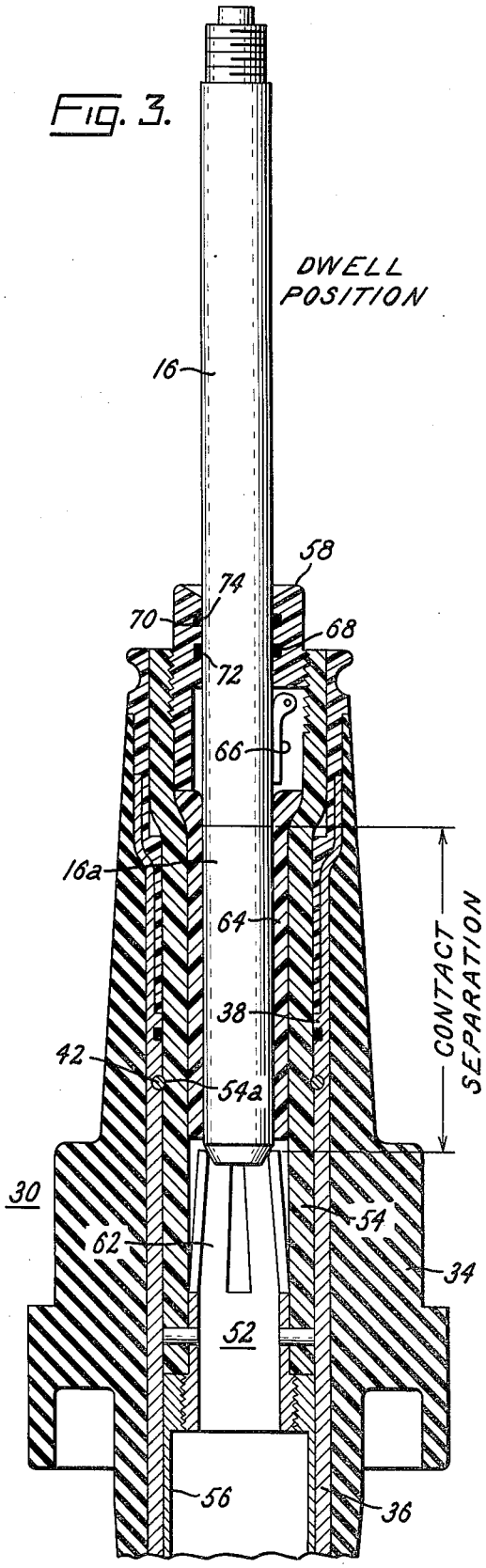
FIG. 3 is a partially broken away view showing a portion of the separable electrical connector module of FIG. 1 in dwell position in the switch module of FIG. 2.

Referring now to FIG. 3, the operating characteristics of the separable electrical connector and switch modules hereinbefore described will now be discussed. FIG. 3 shows the separable electrical connector and switch modules hereinbefore described during a load-make operation in the dwell position immediately preceding the electrical engagement of the connector and switch modules. Note that in the dwell position of FIG. 3, the arc follower **16*a* of the rod contact member 16 is just contacting the bore grasping contact 62 of the switch module 30**. It is at this point that the significance of the separable electrical connector assembly of the present invention can be more fully described and appreciated.

Figure 4:
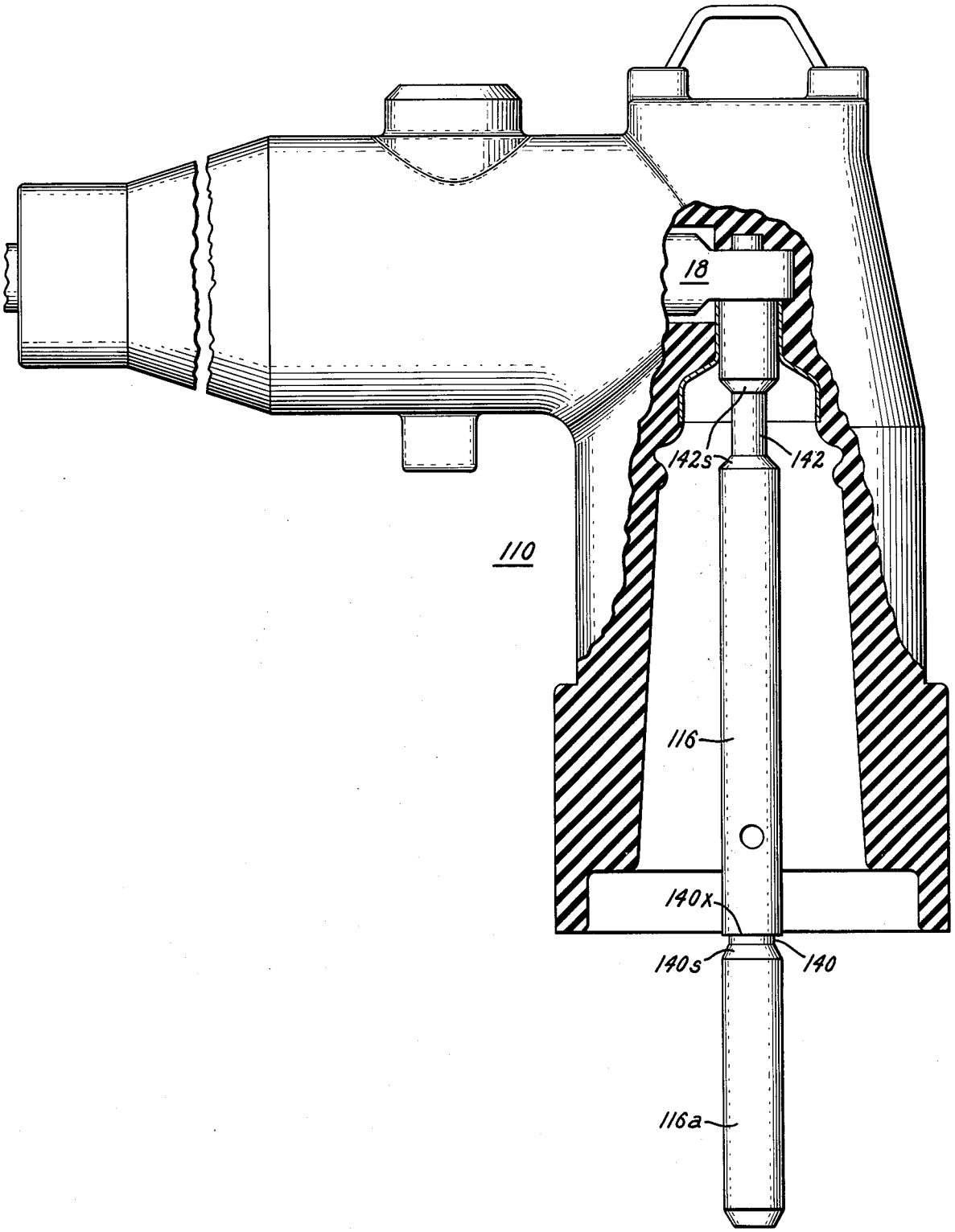
FIG. 4 is a partially broken away side view, taken as in FIG. 1, showing the rod contact member associated with one form of separable electrical connector assembly of the present invention.

Referring now to FIG. 4, a portion of one exemplary form of the separable electrical connector module of the present invention is generally designated 110. In this description where possible, like elements are represented by like reference numerals. In accordance with the present invention, the connector module structure 110 shown in FIG. 4, although substantially the same as the structure shown in FIG. 1, includes several modifications thereof. More particularly, referring to the rod contact member 116, the junction between the arc follower **116*a* and the metal rod 116 is provided with a recess 140. The recess 140 is preferably formed in the arc follower 116*a* as this does not reduce the contact surface of the metal rod 116. In addition, the rod contact 116 is preferably provided with a stress relief recess 142 at a portion thereof which is located a predetermined distance from the junction recess 140. Each of the recesses 140 and 142 has a bottom wall which is preferably of substantially the same diameter. The diameter of the bottom wall is smaller than the outside diameter of the rod contact member 116. The side walls 142*s* of the rod contact relief recess 142 are smoothly tapered from the bottom wall of the recess 142 to the outside diameter of adjacent portions of the rod contact member 116. The junction recess 140 includes a similarly tapered side wall 140*s* at the end adjacent the arc follower 116*a*. In addition, the junction recess 140 includes an untapered sidewall 140*x* which may, for example, connect the bottom wall of the junction recess 140 to the outside diameter of the adjacent portion of the rod contact 116 at an angle of about 90° to the longitudinal axis of the rod contact member 116**.

In accordance with the present invention, the switch module 30 hereinbefore described is also modified. In one embodiment, the modification comprises replacing the outer gas sealing "O" ring gasket 74 of the switch module 30 of FIGS. 2 and 3 with a modified sealing ring 174, hereinafter termed modified stop ring 174, of substantially the same dimensions but of a different material. Referring now to dimensions, in a typical situation, an outer gas sealing ring gasket 74 having an inside diameter of 0.487" and a circular cross section with a diameter of 0.103" is replaced with a modified stop ring 174 having an inside diameter of 0.463" and a circular cross section with a diameter of 0.093". The modified stop ring 174 is preferably made of a material having a combination of high tensile strength, resilience, sliding abrasion resistance, and hardness. Typical physical properties of the modified stop ring material are: 7,000 psi ultimate tensile strength; 1,270 psi 100% modulus; 175 NBS index abrasion resistance, and 93 Shore A hardness. Suitable materials include members of the family of urethane elastomers. One suitable material may be provided by compounding a urethane polymer, such as the one commercially available from E.I. du-Pont de Nemours & Company under the trademark "Adiprene".

Figure 5:
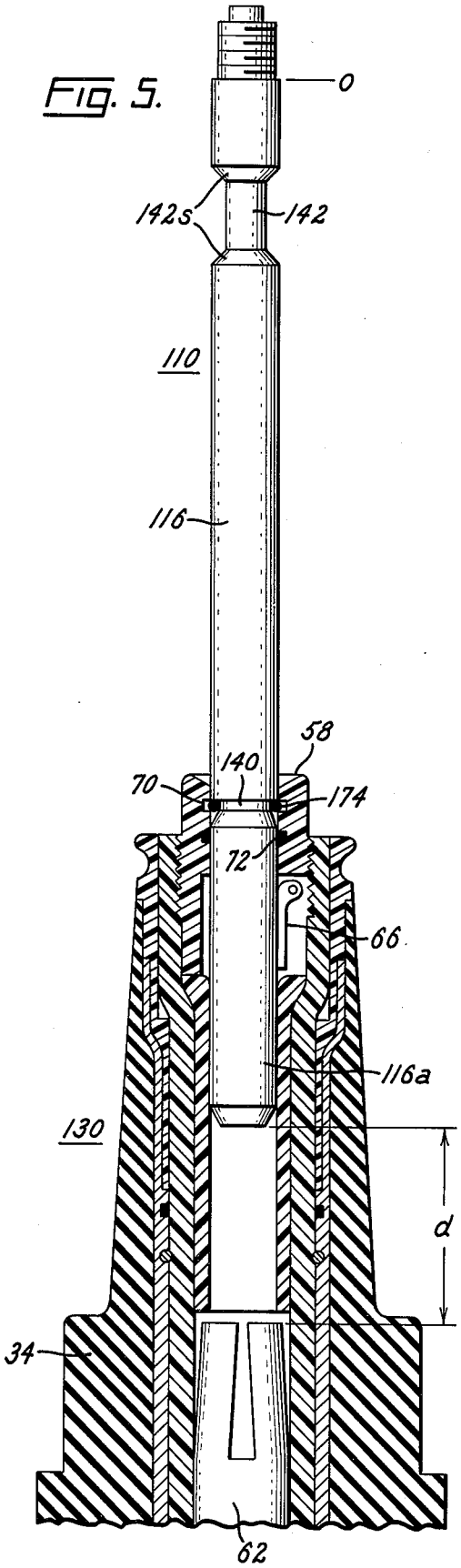
FIG. 5 is a partially broken away side view, taken as in FIG. 3, showing a portion of the separable electrical connector assembly of the present invention with the connector module in a "modified dwell position" in the switch module.

The operation of the separable electrical connector and switch modules 110 and 130 of the present invention will now be discussed in connection with FIGS. 5 and 6. FIG. 5 shows pertinent portions of the connector and switch modules 110 and 130 of the present invention in a "modified dwell" position in which the arc follower **116*a* is not engaged with the bore grasping contact 62 of the switch module 130. Instead, in this embodiment, the first point of noticeable resistance, perceived by the operator, and, corresponding to the conventional dwell position, is provided by the engagement of the junction recess 140 of the rod contact member 116 and the modified stop ring 174 of the switch module 130. More particularly, referring to FIG. 5, it can be seen that as the tapered arc follower 116*a* initially enters into, and passes through, the slightly smaller inside diameter of the modified stop ring 174, the stop ring 174 flows and displaces into the stop ring groove 70. Next, the conventional gas sealing "O" ring gasket 72 compresses, allowing the arc follower 116*a* to easily pass therethrough. Then, upon further insertion, the arc follower 116*a* meets the flapper valve assembly and causes the valve flapper 66 to open. The resistance provided thus far to the insertion of the rod contact member 116 is generally interpreted by the operator to be a slight resistance, not amounting to a "noticeable resistance". Thus, the operator continues to insert the rod contact member 116 into the switch module 130. As the rod contact member 116 is further inserted into the switch module 130, a point is reached at which the junction recess 140 of the rod contact member 116 is aligned with the stop ring 174 of the switch module 130, as shown in FIG. 5. The smaller diameter of the bottom wall of the junction recess 140 in relation to the diameter of the adjacent portion of arc follower 116***a* allows the previously displaced modified stop ring 174 to return to its original shape. When the stop ring 174 returns to its original shape, at least a portion thereof moves into the junction recess 140, resulting in an increased resistance to further insertion of the rod contact member 116. To the operator, this increased resistance to further insertion corresponds to the conventional dwell position, but for reasons which will soon be apparent, this position is termed the "modified dwell" position.

Figure 6:
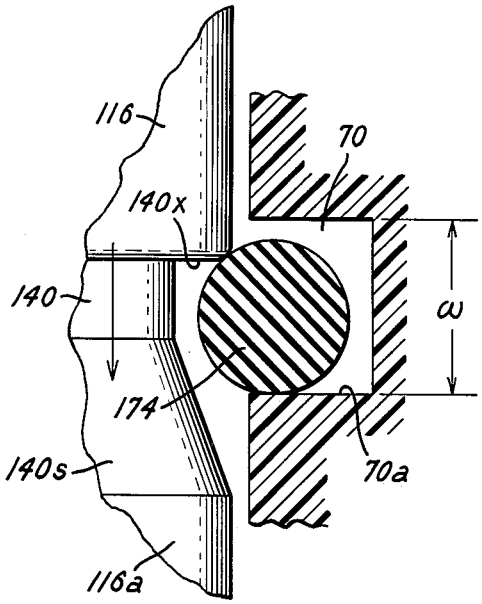
FIG. 6 is an enlarged partially sectioned front elevational view showing the mechanism by which the modified dwell position of FIG. 5 is obtained.

The mechanism which provides the increased resistance corresponding to the "modified dwell" position of the present invention is shown more clearly in FIG. 6. In FIG. 6, at the modified dwell position, further insertion of the rod contact member 116 in the direction of the arrow is resisted by the stop ring 174 which has returned to its original shape, thereby wedging between the untapered side wall 140*x* of the junction recess 140 and the wall 70*a* of the collar annular groove 70. This results in a positive resistance to any further insertion of the rod contact member 116 into the switch module 130. The magnitude of this resistance is preferably chosen to give the operator the same resistance as would be given were the arc follower 116*a* engaging the bore grasping contact 62. (Exemplary construction details for providing such a resistance will be discussed later). Thus, the separable electrical connector and switch modules of the present invention provide a modified dwell position corresponding in feel and resistance to the closing motion of the commonly employed dwell position.

The modified dwell position of the separable electrical connector assembly of the present invention provides at least one significant advantage which becomes quite clear in comparing the dwell and modified dwell positions respectively shown in FIGS. 3 and 5. More particularly, in relation to the conventional separable electrical connector assembly of FIG. 3, the "modified dwell position" of the present invention shown in FIG. 5 is accomplished at a point at which an increased separation of predetermined distance d is provided between the metal contact rod and the bore grasping contact. The result is that a given standard dimensioned separable electrical connector assembly becomes safely capable of withstanding higher operating voltage due to the increased separation provided at the modified dwell position. It is important to note that the modified dwell position provided by the modules of the present invention is accomplished while preserving interchangeability of dimensionally standardized connector parts. In addition, the modified dwell position is provided while continuing to provide desirable gas sealant means, i.e., the conventional gas sealing "O" ring gasket and the valve assembly.

Referring again to FIG. 5, when the operator is ready to electrically engage the rod and bore contacts (immediately following the dwell or "modified dwell position"), an initial moving force overcomes the noticeable resistance and causes the stop ring 174 to flow and displace back into the stop ring groove 70 in the collar unit 58. This allows the rod contact member 116 to pass through easily, resulting in the fully electrically engaged contact position shown in FIG. 7. It is to be noted that, in the event of loadmake under fault conditions, the sliding piston 56 becomes operative. That is, the generation of large amounts of gas, as a result of arcing, drives the piston 56 forward to the rod contact member 116 with considerable force. In the process, the container tube annular groove 54*a* will be released from the steel retaining ring 42 and the bore contact 62 will be speedily engaged with the rod contact member 116.

Figure 7:
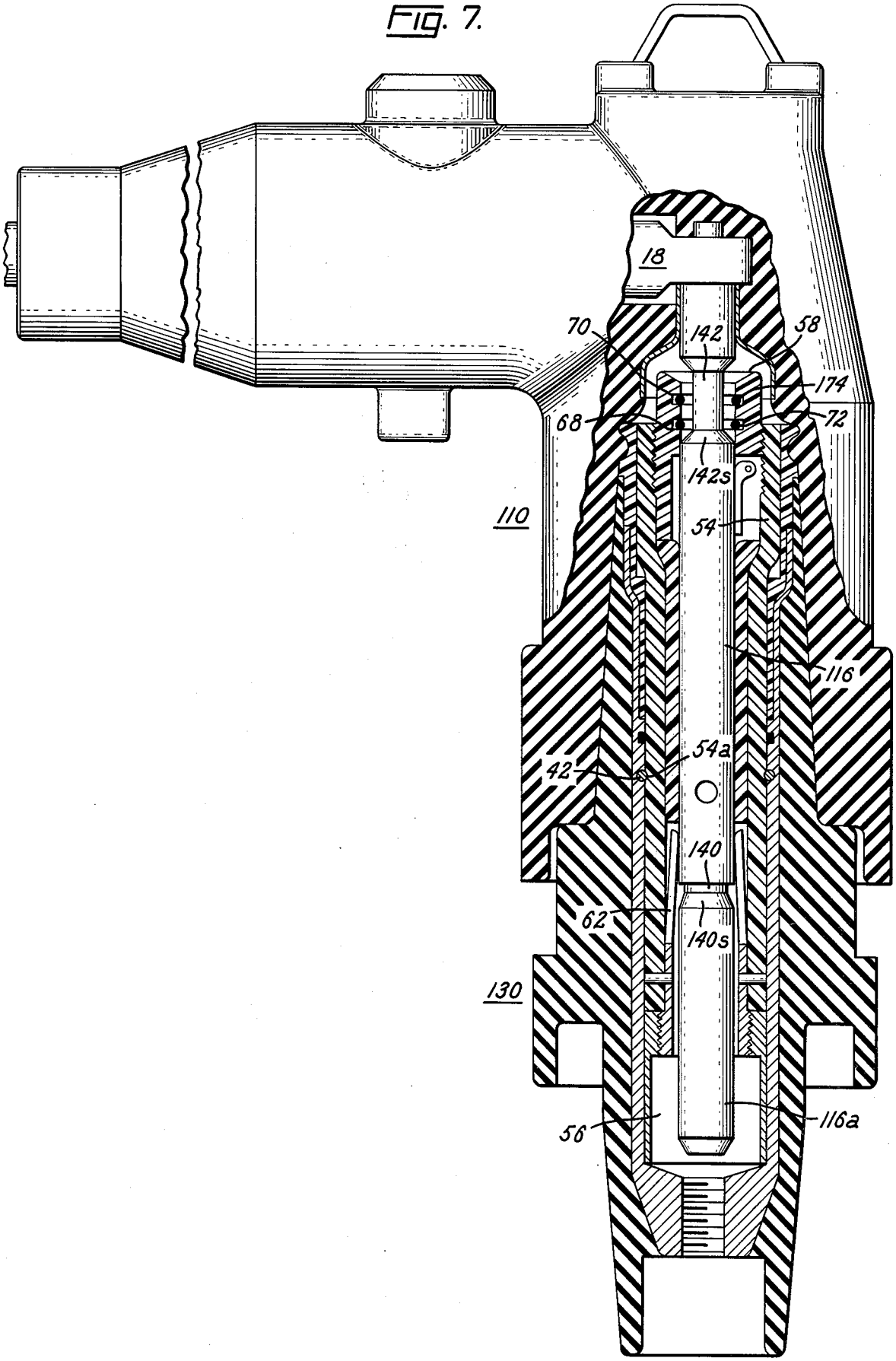
FIG. 7 is a partially broken away side view showing a portion of the connector and switch modules which comprise one form of the separable electrical connector assembly of the present invention. In this Figure, the connector assembly is shown in the fully electrically engaged position.

Referring to the electrically engaged position of FIG. 7, the function of the stress relief recess 142 in the contact rod member 116 can now be appreciated. In the fully electrically engaged position shown in FIG. 7, the contact rod relief recess 142 is positioned so as to receive the "O" ring gasket 72 and the stop ring 174, thereby allowing the modified stop ring 174 and the conventional gas sealing "O" ring gasket 72 to return to their original shapes. The relaxation of the modified stop ring 174 and conventional "O" ring 72 to their original shapes is desirable as thermal set during long term cyclic overloading might interfere with their operation. It is to be noted that thermal set is less likely with the conventional gas sealing "O" ring gasket 72 so that, if desired, a rod contact relief recess need not be provided therefor.

For breaking electrical contact, i.e., loadbreak operation, the rod contact member 116 is removed from the switch module 130. During this removal, the tapered sidewalls 142*s* and 140*s* in the contact rod relief recess 142 and in the junction recess 140 allow displacement of the stop ring 174 and conventional "O" ring 72 into the respective grooves 70 and 68 in the collar unit 58 without causing the positive resistance described above in connection with FIGS. 5 and 6. It is to be noted that, when the rod contact member 116 is being removed from the switch module 130 under normal conditions, movement of the container tube 54 is inhibited by the interaction of the steel retaining ring 42 and the shallow annular groove 54*a*.

Exemplary construction details for providing the noticeable resistance in one form of the separable electrical connector assembly of the present invention (rated 15.2/26.3 kV), as hereinbefore described and shown in FIGS. 4–7, are as follows: Referring now to the approximate dimensions of the rod contact member 116, length from beginning of threaded end (designated O in FIG. 5) to opposing end is 7.60"; diameter of 0.500"; and relief recess 142 diameter of 0.420" with tapered sidewalls extending along about 0.12" lengthwise. The relief recess begins about 0.76" from the beginning of the threaded end. The relief recess extends over a length of 0.50". The arc follower 116*a* has a length of 2.36" and a diameter of 0.494". The junction recess 140 is formed in the arc follower 116*a*, has a diameter of 0.420" and extends over a length of about 0.05". The tapered sidewall of the junction recess 140 extends along about 0.12" lengthwise with the untapered sidewall of the rod contact member 116 having a slightly rounded corner, e.g., 0.02" radius. Referring now to the stop ring 174 and stop ring groove 70 shown most clearly in FIGS. 5 and 6, the groove 70 has a diameter of 0.675" and a groove width w of 0.120". The modified stop ring 174 has an inside diameter of 0.463" and a circular cross section with a diameter of 0.093". The stop ring 174 comprises the previously discussed urethane elastomer.

Although the separable electrical connector assembly of the present invention has hereinbefore been described in connection with an elbow rod connector module and a bore switch module, it is equally applicable to other forms of separable electrical connector assemblies. Further, the invention contemplates the use of other means for providing an artificial stop or "modified dwell position". For example, other means may include a ball and socket type structure in place of the ring and groove structure. In one type of ball and socket type structure, the rod contact member may include the socket portion and the collar assembly unit may include a fixedly disposed ball. In addition, the "modified dwell position" provided by the separable electrical connector assembly of the present invention is suitable for use in other types of connector assemblies. For example, the invention is useful in a non-gas assisted separable electrical connector assembly as well as a gas assisted electrical connector assembly.

While I have illustrated preferred embodiments of my invention, many modifications will occur to those skilled in the art and I therefore wish to have it understood that I intend in the appended claims to cover all such modifications as fall within the true spirit and scope of my invention.

What I claim as new and desire to secure by Letters Patent of the United States:

1. A separable electrical connector assembly of the type including mating switch and connector modules respectively having mating bore and rod contact members, each of the modules including an insulating housing with portions thereof having closely matched configurations so as to form a substantially insulating seal when the modules are mated together, the rod contact member including an arc follower at a contact engaging end thereof, the assembly including means for providing a noticeable physical resistance to further insertion of the rod contact member into the switch module beyond a first insertion, the noticeable physical resistance being provided by the engagement of the arc follower and the bore contact member, this resistance being encountered during a make operation in a dwell position of the rod connector module immediately following which electrical engagement of the rod and bore contact members is made, wherein the improvement comprises:

means for providing a modified dwell position at which said arc follower is separated by a predetermined distance from said bore contact member and at which further insertion of said rod contact member into said switch module is met by a noticeable physical resistance which is substantially equivalent to said noticeable physical resistance.

2. A separable electrical connector assembly in accordance with claim 1 in which said rod contact member includes first means for engaging second means of said switch module, said first and second means being effective when engaged at said modified dwell position to provide said noticeable resistance to further insertion of said rod contact member into said switch module.

3. A separable electrical connector assembly in accordance with claim 2 in which said rod contact member and said arc follower are substantially cylindrical and said first means comprises a junction recess disposed between said arc follower and said rod contact member, said junction recess having a diameter smaller than the diameters of adjacent portions of said arc follower and said rod contact member, said junction recess including a bottom wall and a pair of opposing sidewalls connecting said bottom wall to the larger diameter surfaces of said adjacent portions of said arc follower and said rod contact member, one of said sidewalls connecting said bottom wall of said junction recess to said adjacent portion of said rod contact member providing at least some of said noticeable resistance at said modified dwell position.

4. A separable electrical connector assembly in accordance with claim 3 in which said arc follower includes a tapered end portion, said sidewall connecting said bottom wall of said junction recess to said adjacent portion of said arc follower is tapered and said sidewall connecting said bottom wall of said junction recess to said adjacent portion of said rod contact member is substantially untapered.

5. A separable electrical connector assembly in accordance with claim 4 in which said second means comprises at least one stop ring disposed in an annular stop ring groove in said switch module, said stop ring when relaxed having an inside diameter smaller than the diameter of said portions of said arc follower and said rod contact member which are adjacent said junction recess, said stop ring being positioned to receive therethrough said arc follower and said rod contact member.

6. A separable electrical connector assembly in accordance with claim 5 in which said stop ring comprises a material having physical properties so as to provide at least some of said noticeable resistance at said modified dwell position.

7. A separable electrical connector assembly in accordance with claim 6 in which said stop ring comprises an elastomer material.

8. A separable electrical connector assembly in accordance with claim 7 in which said stop ring comprises a urethane elastomer.

9. A separable electrical connector assembly in accordance with claim 5 in which said contact rod member includes a stop ring relief recess located a predetermined distance from said junction recess, said rod contact relief recess being disposed and dimensioned such that when electrical engagement of said bore and rod contact members is made, said stop ring is positioned around and substantially relaxed in said relief recess.

10. A separable electrical connector assembly in accordance with claim 5 in which said switch module further comprises a collar unit having a collar housing, said collar housing including therein a valve assembly for restricting the flow of gases, said collar housing including said stop ring and said annular stop ring groove.

11. A separable connector assembly in accordance with claim 10 in which said collar housing further comprises a second annular groove axially adjacent to said stop ring groove, said second annular groove including therein a gas sealing "O" ring gasket.

12. A separable electrical connector assembly in accordance with claim 1 in which said switch module includes a metal sleeve disposed within said insulating housing, said sleeve including means at one end thereof for securing one end of said switch module to a fixed object, said sleeve including means at the opposing end thereof for securely receiving an insulating nosepiece, an annular slidable conductive contact piston disposed within said metal sleeve in electrical contacting relation therewith, an electrically insulating container tube secured at one end to said slidable piston, said container tube including a snuffer-contact assembly having a snuffer liner and a grasping bore contact adapted to electrically engage said rod contact member.

13. In a rod connector module of the type having an insulating housing with a cylindrical rod contact member disposed therein, the rod contact member having a cylindrical arc follower secured to a contact engaging end thereof, the rod contact member and the rod connector module being of a configuration so as to be electrically mateable with a switch module of the type having a grasping bore contact member, wherein the rod contact member comprises:

a junction recess disposed between said arc follower and said rod contact member, said junction recess having a diameter smaller than the diameters of adjacent portions of said arc follower and said rod contact member, said junction recess including a bottom wall and a pair of opposing sidewalls connecting said bottom wall of said recess to the larger diameter surfaces of said adjacent portions of said arc follower and said rod contact member, one of said sidewalls connecting said bottom wall of said junction recess to said adjacent portion of said rod contact member being substantially untapered and said sidewall connecting said bottom wall of said junction recess to said adjacent portion of said arc follower being tapered and said rod contact member further includes thereon a relief recess located a predetermined distance from said junction recess, said relief recess having a diameter smaller than the diameters of adjacent portions of said rod contact member, said relief recess including a bottom wall and a pair of opposing side walls connecting said bottom wall of said relief recess to the larger diameter surfaces of said adjacent portions of said rod contact member, said relief recess being adapted to receive a stop ring such that said stop ring is positioned around and substantially relaxed in said relief recess.

14. A rod connector module in accordance with claim 13 in which the unsecured end of said arc follower is tapered.

15. A rod connector module in accordance with claim 13 in which said sidewalls of said relief recess are tapered.

16. A rod connector module in accordance with claim 13 in which said rod contact member and said arc follower have a diameter of about 0.500" and said bottom wall of said junction recess has a diameter of about 0.420".

17. A rod connector module in accordance with claim 13 in which said arc follower comprises acetal copolymer resin loaded with melamine, said melamine comprising from about 20% to about 60% by weight.

* * * * *